United States Patent [19]

Schnut

[11] Patent Number: 5,004,873

[45] Date of Patent: Apr. 2, 1991

[54] PLURAL SET POINT PRESSURE RESPONSIVE SWITCHING APPARATUS UTILIZING A SINGLE PRESSURE SENSING DRIVER ELEMENT

[75] Inventor: Robert H. Schnut, Carmel, N.Y.

[73] Assignee: Eaton Corporation, Cleveland, Ohio

[21] Appl. No.: 410,174

[22] Filed: Sep. 20, 1989

[51] Int. Cl.[5] ..... H01H 35/32

[52] U.S. Cl. ..... 200/83 P; 73/729; 200/81.4; 200/83 C; 200/83 S

[58] Field of Search ..... 340/626; 307/118; 73/861.47, 717, 723, 744, 745, 729; 200/81.4, 83 R, 83 S, 83 SA, 83 T, 83 W, 83 J, 83 C, 83 P

[56] References Cited

U.S. PATENT DOCUMENTS

| | | | |
|---|---|---|---|
| 3,790,730 | 2/1974 | Wyland | 200/153 V |
| 4,243,857 | 1/1981 | Reis | 200/83 C |
| 4,297,552 | 10/1981 | Lauritsen et al. | 200/83 P |
| 4,392,034 | 7/1983 | Payne | 200/81.4 |
| 4,400,601 | 8/1983 | Brucken | 200/81.4 |
| 4,458,117 | 7/1984 | Johnson | 200/83 P |
| 4,467,155 | 8/1984 | Grudzien, Jr. et al. | 500/81 R |
| 4,479,039 | 10/1984 | Payne | 200/67 D |
| 4,524,255 | 6/1985 | Haag | 200/83 R |
| 4,525,611 | 6/1985 | Akamatsu | 200/83 S |
| 4,532,389 | 7/1985 | Woods | 200/83 P |
| 4,591,677 | 5/1986 | Hirota | 200/83 P |
| 4,783,580 | 11/1988 | Bassin | 200/81.4 |
| 4,843,364 | 6/1989 | Place | 200/81.4 |
| 4,853,594 | 8/1989 | Tanaka et al. | 200/83 P |
| 4,900,883 | 2/1990 | Brame . | |

*Primary Examiner*—Gerald P. Tolin

*Attorney, Agent, or Firm*—L. G. Vande Zande

[57] ABSTRACT

An actuator having a spring biased button abutting a first electric switch operator button and a flange spaced from an operator button of a second electric switch is driven by a pressure sensing bellows against a Belleville snap spring, the actuator moving abruptly against an intermediate stop upon breakover of the snap spring to operate the first switch, the bellows subsequently driving the actuator and intermediate stop coincidentally against a second Belleville snap spring, and the actuator moving abruptly against a second stop upon breakover of the second snap spring to actuate a second electric switch and depress the spring biased button. Adjustment means are provided for adjusting the range for each Belleville snap spring to provide distinct pressure set points and independent electric circuits, and to adjust both set points simultaneously.

24 Claims, 2 Drawing Sheets

PLURAL SET POINT PRESSURE RESPONSIVE SWITCHING APPARATUS UTILIZING A SINGLE PRESSURE SENSING DRIVER ELEMENT

BACKGROUND OF THE INVENTION

This invention relates to pressure responsive electric switching apparatus. In particular, it relates to apparatus of the aforementioned type having plural distinct switching set points with independent electrical circuits operated by a single pressure sensing element.

Pressure switches presently available have a single switching circuit associated with the pressure sensing element. Applications for switching of separate distinct circuits at plural predetermined pressure values require independent pressure switches, each switch having a sensing element and an electrical circuit. Such duplication increases volume space requirement, weight and cost to achieve the desired pressure responsive switching apparatus.

SUMMARY OF THE INVENTION

This invention provides pressure responsive electric switching apparatus having plural set points at which plural distinct switches are operated, the switches being operated by a single pressure sensing driver element. This apparatus is unitarily contained in a single housing, incorporating a series of force breakover devices which block movement of the pressure responsive driver element until the force applied by the driver element attains the predetermined value of a respective force breakover device, whereupon the apparatus snaps abruptly to operate a respective switch. Mechanical stops provide incremental movement of the driver element and its associated switch actuator. Adjusting means associated with each force breakover device provide individual adjustment of the respective pressure value at which the respective switching functions occur, and a separate adjustment is provided to adjust all set points simultaneously and uniformly. The invention further incorporates protection against over-travel and over-pressurization of the apparatus. The switching apparatus is particularly well suited for applications experiencing vibration and/or mechanical shock.

The invention, its features and advantages, will become more readily apparent when reading the following description and claims in conjunction with the accompanying drawings.

DETAILED DESCRIPTION OF THE PREFERRED EMBODIMENT

Figure 1:
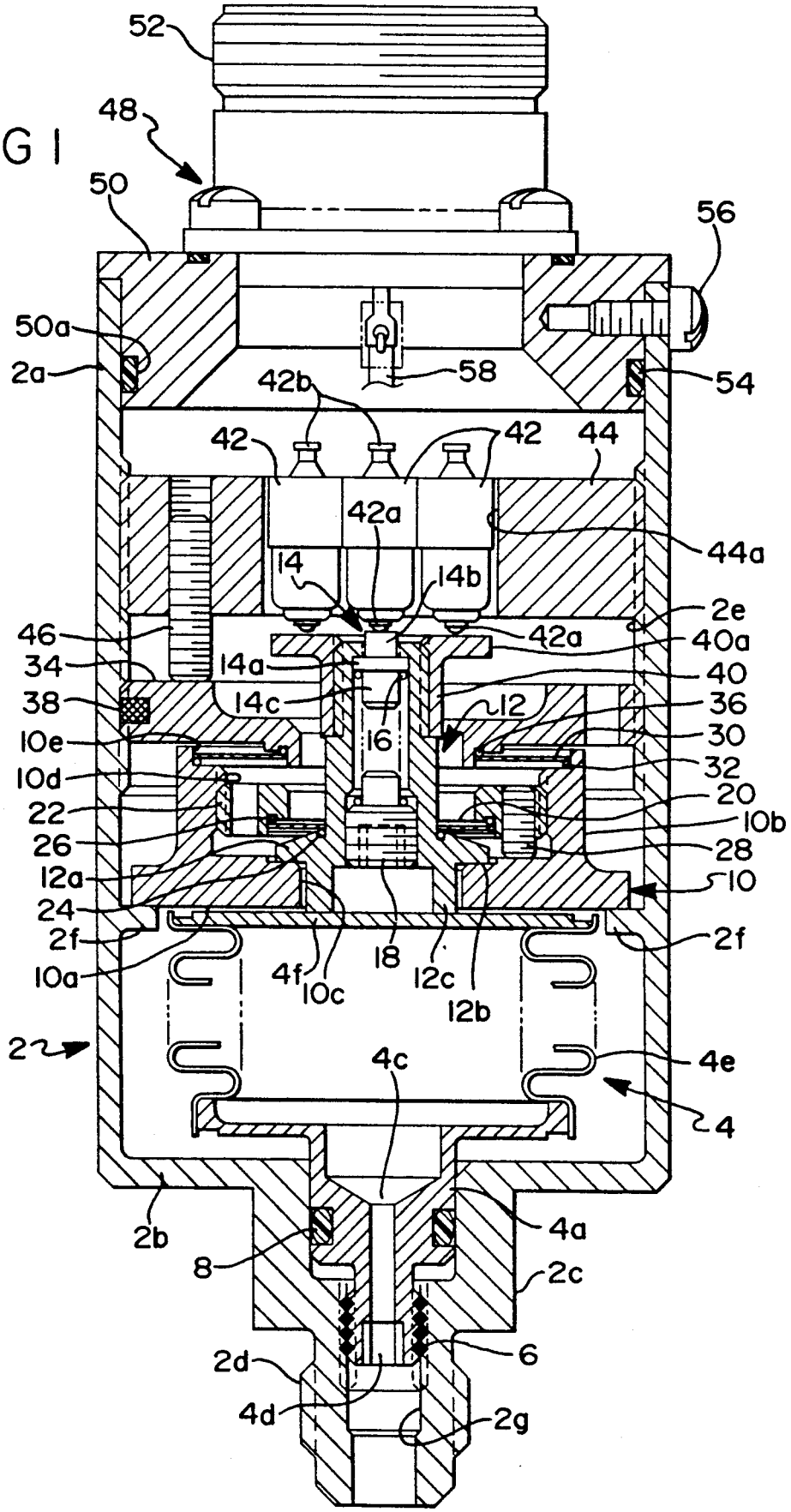
FIG. 1 is a cross sectional view taken along the axial center line of the plural set point pressure responsive electric switching apparatus of this invention.
Figure 2:
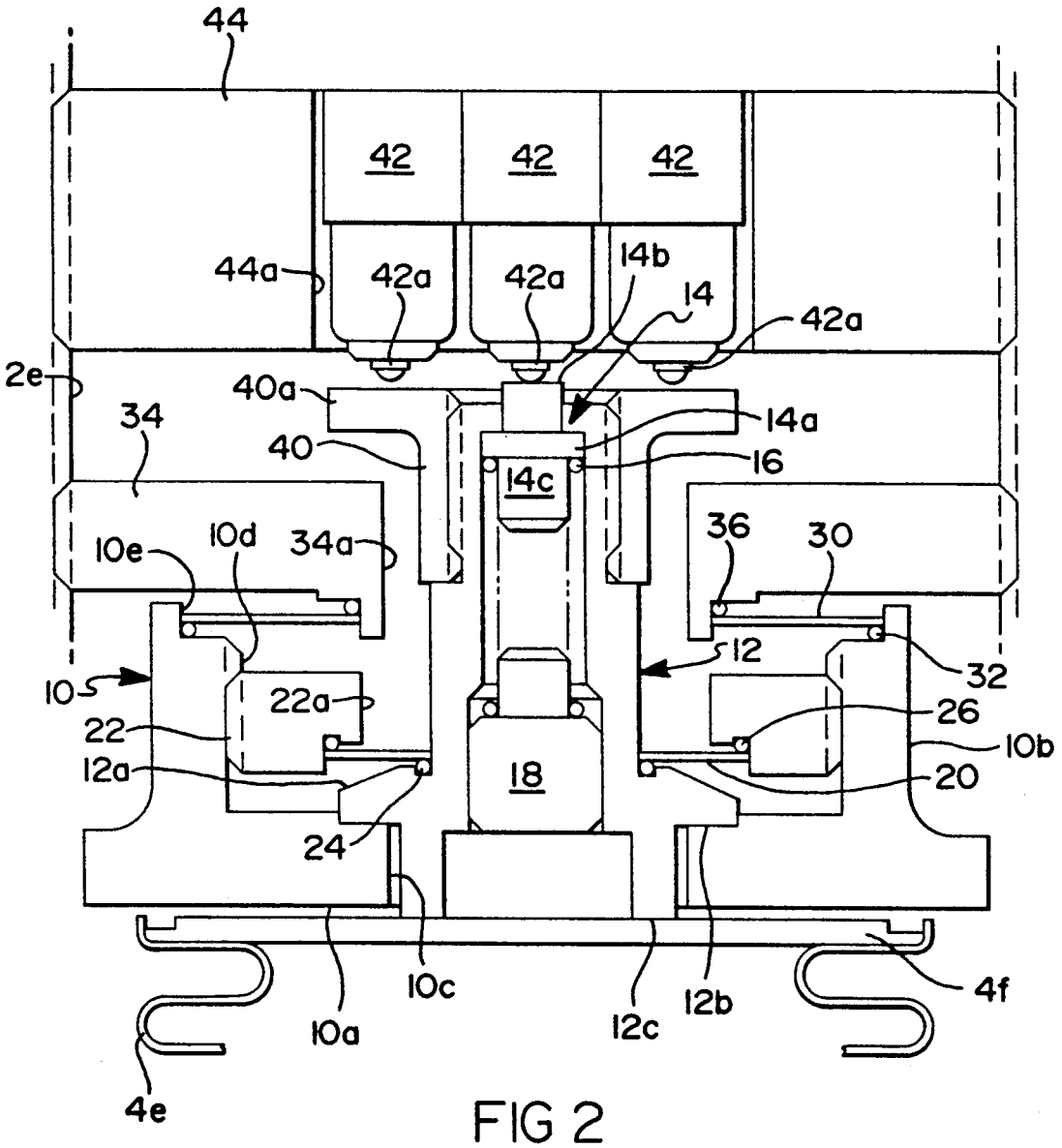
FIG. 2 is a generally schematic illustration of the switching apparatus of FIG. 1, drawn to an enlarged scale.

With reference to the drawings, the plural set point pressure responsive electric switching apparatus of this invention is, by way of example, illustrated in a dual set point embodiment. A hollow cylindrical housing 2 is open at a first end 2*a* and substantially closed at an opposite end by an end wall 2*b* from which an integral hub 2*c* and a threaded stem 2*d* project coaxially. Hub 2*c* is preferably hexagonally shaped to facilitate mounting the apparatus with a tool, such as a wrench or the like.

Housing 2 has an internally threaded central portion 2*e* and a plurality of radially inwardly directed shelf-like projections 2*f* arranged in an annular ring between threaded portion 2*e* and end wall 2*b*. An annularly stepped opening 2*g* extends through end wall 2*b*, hub 2*c* and stem 2*d* Stem 2*d* is externally threaded for mounting the apparatus to a manifold, tank or other pressure source. The opening 2*g* is internally threaded to receive a threaded ferrule of an end cap 4*a* of a bellows assembly 4. A helical sealing and positioning coil 6 is disposed between the external threads on the ferrule of end cap 4*a* and the internal threads in opening 2*g*. A cylindrical hub portion of end cap 4*a* is provided with an annular groove 4*b* in which is disposed an O-ring 8 to further provide a seal between housing 2 and belows assembly 4. The cylindrical hub and projecting ferrule of end cap 4*a* are provided with an axial passage 4*c* extending therethrough, the outer end of passage 4*c* in the ferrule being enlarged to an internal hexagonal shape 4*d* to receive an Allen wrench or the like to adjust the axial position of bellows assembly 4 with respect to housing 2. A formed metal bellows element 4*e* is affixed at one open end thereof to end cap 4*a* by welding, brazing, or the like and has a second planar disc end cap 4*f* affixed at its opposite open end by a similar method.

A cylindrical intermediate stop member 10 has a flat disc surface 10*a* at a lower side and a hollow cylindrical body 10*b* extending from the upper side with respect to the orientation of the apparatus in the drawings. Stop member 10 is disposed for axial movement within housing 2 with flat surface 10*a* resting upon projections 2*f*. Stop member 10 has a central opening 10*c* extending axially therethrough communicating with a concentric, substantially larger internally threaded bore 10*d* in the cylindrical body 10*b*. The end of body 10*b* has a shallow counterbore 10*e* which is diametrically larger than internally threaded bore 10*d*, thereby providing an annular shoulder in the upper end of body 10*b*.

A generally cylindrically shaped actuator 12 is disposed within intermediate stop member 10. Actuator 12 has a frustoconical annular flange 12*a* near a lower end which has a right angle face 12*b* formed on the under side thereof with respect to the orientation shown in the drawings. A cylindrical ring 12*c* depends from face 12*b* at the lower end of actuator 12, extending through the opening 10*c* of stop member 10 whereby the end of ring 12*c* rests squarely upon the planar surface of end cap 4*f* of bellows assembly 4. The upper surface of stop member 10 around the central opening 10*c* is spot faced as shown in the drawings for an accurate dimensional tolerance control of the projection of ring 12*c* through stop member 10. Actuator 12 has a stepped cylindrical opening extending axially therethrough, the opening being restricted at the upper end of the actuator to provide an annular shoulder against which an annular collar 14*a* of a button 14 abuts. Button 14 has a cylindrical projection 14*b* projecting upwardly through the opening in the end of actuator 12 and a cylindrical boss 14*c* depending from collar 14*a* within the opening in actuator 12. Boss 14*c* and collar 14*a* form a seat for one end of a helical compression spring 16 disposed within the opening in actuator 12. The lower end of the opening within actuator 12 is enlarged and internally threaded to receive an Allen head cap screw 18 which serves as an adjustable seat for the opposite end of spring 16. The amount of force applied by spring 16 upon button 14 can be adjusted by rotating cap screw 18.

A force breakover device 20 such as a Belleville snap spring is disposed over the cylindrical body of actuator 12. Snap spring 20 is a washer-like element which annularly surrounds actuator 12 the inner diameter abutting flange 12*a*. A spanner nut 22 is threaded into internally threaded bore 10*d* of intermediate stop 10, the spanner nut having a central aperture 22*a* through which actuator 12 extends and a counterbore concentric with aperture 22*a* adjacent the lower surface thereof. The outer diameter of snap spring 20 rests within the counterbore of spanner nut 22. To reduce friction at the inner and outer diameters of snap spring 20 where it engages actuator 12 and spanner nut 22, respectively, a pair of metal rings 24 and 26 are positioned in shallow grooves in actuator 12 and spanner nut 22, respectively. Steel rings 24 and 26 provide respective tangent point line of contact with snap spring 20. Belleville snap springs such as 20 are responsive to a unidirectional axial force such as can be applied at the inner diameter by actuator 12 when driven upward by bellows assembly 4. Snap spring 20 remains rigid, blocking movement of actuator 12, until the force applied by pressure build-up in bellows assembly 4 attains a predetermined threshold or breakover value whereupon the inner diameter of spring 20 snaps through the plane of the outer diameter. Such snap movement creates stored potential energy in spring 20 which, when released, will return the spring to its original condition. The spring is manufactured with a finite range at which snap action transition occurs, e.g. snap action from the original condition to the second condition might occur at a force of 25 pounds and return snap action from the second condition to the original condition may occur when the force reduces to 20 pounds. The original finite range can be fine tuned to respond at a narrower range, e.g. at 23 pounds on increasing force and 22 pounds on decreasing force, by applying an initial preload on snap spring 20 through adjustment of spanner nut 22 within the internally threaded bore 10*d* of intermediate stop member 10. Spanner nut 22 carries three set screws 28 (only one of which is shown in the drawings) at equally spaced arcuate locations, whereby the adjustment by spanner nut 10*d* can be locked by tightening set screws 28 against the interior surface of intermediate stop member 10.

A second Belleville snap spring 30 is positioned within the counterbore 10*e* at the upper end of intermediate stop member 10 upon a steel ring 32. A spanner nut 34 is threaded into the internally threaded portion 2*e* of housing 2. Spanner nut 34 has a central aperture 34*a* through which actuator 12 projects. The lower side of spanner nut 34 adjacent to intermediate stop 10 functions as a stop surface against which member 10 may abut. A shouldered central hub depends from the lower surface of spanner nut 34 and has a shallow annular groove at the base of the shoulder thereof in which is disposed a steel ring 36. The inner diameter of snap spring 30 abuts ring 36 while the outer diameter thereof abuts ring 32 for reducing friction as previously described in connection with Belleville snap spring 20 and rings 24 and 26. As will be described more fully hereinafter, force is applied to snap spring 30 at the outer diameter thereof by intermediate stop member 10. The finite range of snap spring 30 is fine tune adjusted by the axial position of spanner nut 34, which also determines a permitted increment of axial movement of intermediate stop member 10 between projections 2*f* and the under side of spanner nut 34. A cylindrical nylon insert 38 is disposed in a radially directed hole in the threaded periphery of spanner nut 34 to provide an interference fit with the threads of spanner nut 34 and the internally threaded portion 2*e* of housing 2 to lock spanner nut 34 in its adjusted position.

A cylindrical cap 40 is threadably attached on the upper end of actuator 12. Cap 40 has an annular flange at its upper end which preferably is hexagonal to facilitate the threaded attachment to actuator 12, the flange also providing a flat disc surface for actuating one or more miniature precision snap action switches 42 as will be described hereinafter. As can be seen in the drawing, the cylindrical projection 14*b* of button 14 projects above the surface of flange 40*a* of cap 40, the projection 14*b* serving to actuate another miniature precision snap action switch 42. The switches 42 are self-contained astable snap action switches operated by depression of a spring loaded button plunger 42*a*. Miniature precision switches 42 have a pair of holes that extend transversely through the housing to receive mounting screws. The switches 42 of the apparatus of this invention are disposed within a rectangular aperture 44*a* of a switch mounting screw 44 which is threadably inserted into the internally threaded portion 2*e* of housing 2 to be spaced above spanner nut 34. While not shown, a pair of screws are inserted into transverse holes in switch mounting screw 44 to extend across the rectangular aperture through the respective mounting holes of switches 42 to secure the switches within the rectangular aperture 44*a*. The axial position of switches 42, particularly the button plungers 42*a* thereof, with respect to button extension 14*b* and cap flange 40*a* of actuator 12, is adjusted by appropriate rotation of switch mounting screw 44 within the threaded portion 2*e*. The final position is locked by turning three set screws 46 (only one of which is shown), which are spaced at equal arcuate intervals in the switch mounting screw 44, inwardly to abut the upper surface of spanner nut 34.

A cover assembly 48 comprising a disc shaped cover 50 having a multiple pin threaded connector 52 attached thereto is disposed in the open end 2*a* of housing 2. An annular groove 50*a* is formed in the cylindrical surface of cover 50 to receive an O-ring 54 to establish an environmental seal for the housing. Cover 50 is secured to the end 2*a* of housing 2 by three radially directed screws 56 (only one of which is shown) which pass through clearance openings in housing 2 and threadably engage appropriately aligned threaded holes in cover 50. While not shown in detail, wire conductors 58 are appropriately joined between interior terminals of connector 52 and terminals 42*b* of switches 42 to permit appropriate electrical connection to the switches externally of the switching apparatus.

A still further adjustment of both set points can be simultaneously effected by inserting an Allen head wrench into the hexagonal opening 4*d* of end cap 4 and rotating the bellows assembly 4, particularly the threaded end ferrule of end cap 4*a*, within the housing opening 2*g* to adjust the spring force provided by bellows assembly 4 on the actuator 12 and snap spring 20, and through snap spring 20 and intermediate stop member 10 on snap spring 30.

The switching apparatus as hereinbefore described provides sequential two stage electrical switch actuation at two distinct set points in response to actuation by a single pressure responsive driver element such as bellows assembly 4, or a piston, diaphragm or the like.

Switching apparatus of this type may, by example, be used in applications requiring verification of the integrity of an over pressure sensing element. Normal operation would have a set point of the over-pressure device above a normal operating pressure so as to be operated only when the pressure exceeds that set value. Thus, normal operation would not operate the over-pressure switch and therefore it would not be known that the switch was in fact operational. With the switching apparatus of this invention, a first set point can be established at a value lower than the normal operating pressure and a second set point can be established for the over-pressure value. The first switch will always be actuated upon startup of the pressurized system, thereby verifying the integrity of the switching apparatus. Another exemplary application of the switching apparatus of this invention would be to provide a warning device within a single switching apparatus. For example, the switch may be used to sense oil pressure in an internal combustion engine. The first set point can be set to indicate low oil pressure when the first stage center switch is actuated. The second set point is set at proper operating pressure. The apparatus functions to operate the second stage outboard switches at proper oil pressure to override the low pressure signed from the first stage switch. If an oil filter begins to clog and pressure falls, the second stage switches will be de-actuated, and the signal from the first stage switch will indicate the low pressure condition. The decreasing set point for the first stage can be set at a critical point whereby de-actuation of the first stage switch may close normally closed contacts to signal a failure, or to energize emergency shut down equipment, or the like. A still further exemplary application of this switching apparatus would be as a wide differential pressure switch wherein the increasing set point of the second stage operation and decreasing set point of the first stage operation are used. This provides a wide hysteresis pressure switch that is adjustable. These exemplary applications of the switching apparatus of this invention will be more clearly understood in the following description of operation of the apparatus.

OPERATION OF THE INVENTION

The dual set point pressure responsive electric switching apparatus hereinbefore described may be connected to a pressure source by threaded connection of the stem 2*d* to a pressurized vessel or other pressure fitting. An appropriate electrical connection is made to the connector 52 to connect the switching apparatus to appropriate control apparatus. It should be noted that the projecting ring 12*c* of actuator 12 initially depends beyond the lower flat disc surface 10*a* of intermediate stop member 10 to abut against the planar surface of end cap 4*f*. A first increment of movement for actuator 12 is defined and controlled by the axial length of ring 12*c* between the flange 12*b* and the end of the ring and by the thickness of the end wall of intermediate stop 10 which is accurately controlled by the depth of the spot face in that end wall against which flange 12*a* seats.

Increasing pressure in bellows assembly 4 exerts a proportionately increasing force on actuator 12 through the abutting engagement of end ring 12*c* with end cap 4*f*. Movement of actuator 12 is blocked by Belleville snap spring 20 until the force attains a breakover value for snap spring 20 set by the adjustment afforded through spanner nut 22 within the intermediate stop member 10. When the force applied thereon attains the threshold or set point value, the inner diameter of spring 20 snaps through the plane of the outer diameter thereof to a second condition, thereby abruptly releasing actuator 12 for upward axial movement, causing button projection 14*b* to depress the button plunger 42*a* of center switch 42, operating that switch to an actuated condition. The amount of upward movement of actuator 12 is limited by abutting engagement of end cap 4*f* of bellows assembly 4 with the surface 10*a* of intermediate stop 10, thereby defining a first increment of travel of actuator 12. This first increment of travel is insufficient to cause flange 40*a* of cap 40 of actuator 12 to operate the outboard switches 42.

Further movement of the end cap 4*f* of bellows assembly 4 in response to increasing pressure is blocked by Belleville snap spring 30 bearing between intermediate stop member 10 and the fixed position spanner nut 34. As the pressure and corresponding force increases, end cap 4*f* applies force against intermediate stop member 10 and consequently snap spring 30. Upon attaining the set point pressure threshold force value, snap spring 30 breaks over to its second condition causing the outer diameter thereof to snap through the plane of its inner diameter, thereby allowing both actuator 12 and intermediate stop member 10 to move abruptly upwardly with a snap action until intermediate stop member 10 engages the lower surface of spanner nut 34, thereby defining a second increment of travel of actuator 12. During this second increment of travel, the flat disc surface of flange 40*a* on actuator 12 depresses the button plungers of outboard switches 42 to actuate these switches simultaneously, thereby effecting the second stage of electrical actuation of the switching apparatus. It should be appreciated that this second stage switching can be accomplished by a single outboard switch 42 and that the provision of two outboard switches is merely redundant.

During the second increment of travel of actuator 12, the button plunger 42*a* of the central switch 42 and/or the surrounding housing of central switch 42 effect depression of button 14 within the central opening of actuator 12 against the bias of spring 16, thereby providing over-travel for the actuator without applying excessive force on the button plunger of central switch 42. Damage to the switching apparatus by exposure of the apparatus to an over pressurization such as during proof pressure of the system is also prevented by providing a fixed stop such as spanner nut 34 and a solid member such as intermediate stop member 10 around the actuator. Accordingly, when intermediate stop member 10 is driven into abutting engagement with the lower surface of spanner nut 34, the end cap 4*f* abuts the surface 10*a* of intermediate stop member 10 directly, thereby forming a solid link connection and preventing further expansion axially of the bellows assembly 4. Inasmuch as actuator 12 rests within a central aperture of intermediate stop member 10, it cannot be driven by end plate 4*f* beyond the axial point at which the end plate 4*f* abuts surface 10*a* of intermediate stop member 10.

As the pressure being monitored reduces in value, the switching apparatus returns to the original position with a sequential snap action two stage operation. Snap spring 30 restores to its initial condition, thereby driving intermediate stop member 10 into engagement with projections 2*f* of housing 2 as the pressure falls below the decreasing set point value for snap spring 30. This movement of intermediate stop member 10 carries with it actuator 12 and end plate 4*f* of bellows assembly 4 and releases the plunger buttons 42*a* of outboard switches 42. Subsequently, as the pressure drops below the decreasing set point for snap spring 20, it snaps to its original condition thereby driving actuator 12 to its original position wherein flange surface 12*b* seats against the spot faced surface of intermediate stop member 10 and the end of ring 12*c* projects beyond the lower surface 10*a*. In this return movement, button 14 releases button plunger 42*a* of central switch 42 to de-actuate that switch.

The apparatus herein described provides two stage sequential snap action movement of an actuator wherein each of the set points can be adjusted to each provide an increasing set point and a decreasing set point. When the switching apparatus of this invention is used in an application to provide verification of the operability of the switching apparatus, normally open contacts of the first or center switch 42 are connected to a signaling device and are operated to a closed position during the first increment of travel of actuator 12. The contacts of one or both of the outboard switches 42 may be connected to an emergency cut-off circuit for a compressor to turn the compressor off when the switching apparatus operates the actuator 12 through its second increment of travel, thereby operating the outboard switches 42. As the pressure within the system drops, actuator 12 will snap through its second stage to release outboard switches 42 to permit re-establishment of a circuit to the compressor subject to other conditions in the control circuit for the compressor. Further decrease in pressure will cause the actuator 12 to reversely move through the first increment of travel to release the center switch 42, thereby resetting the switching apparatus of this invention to the initial conditions.

When this switching apparatus is used in the aforementioned warning device application, the normally closed contacts of the center switch 42 may be connected to a failure alarm/indicator circuit and the normally open contacts of that switch may be connected to a low pressure indicator circuit. The second stage outboard switches 42 may be connected in circuit with the normally open contacts of the center switch to interrupt a signal from the latter when the second stage is actuated, thereby signaling proper oil pressure. As pressure drops, the decreasing pressure deactuates the second stage of the switching apparatus, reconnecting the operated normally open contacts of the first stage center switch to the signaling apparatus. As pressure falls below a critical level, the first stage center switch 42 deactuates to reclose its normally closed contacts which energize a failure indication circuit.

When used in a wide differential pressure switch application, the increasing pressure set point for the second stage outboard switches 42 and the decreasing pressure set point for the first stage center switch 42 are used. Normally open contacts of the outboard switches 42 would be operated closed when a predetermined pressure was attained, re-opening if that pressure fell below that set point, and normally closed contacts of the center switch 42 would be reclosed when the pressure fell below the lower set point value to operate appropriate equipment or signals at the respective pressure values.

It is to be appreciated that this invention provides a plural set point sequential snap action switching apparatus employing a plurality of force breakover devices, each having a distinct finite range of increasing and decreasing force threshold values in association with respective intermediate and a final fixed stop to actuate plural distinct switching circuits. Although the invention is exemplarily described as a two stage, or a dual set point device, additional stages can be readily added by incorporating more force breakover devices and intermediate stops. The set points are adjustable to provide respective finite ranges for increasing and decreasing pressure within that particular set point, having force breakover devices providing snap action to the actuator at the set point. The actuator has over-travel protection for the button plunger of respective non-final stage electrical switches, and a solid link is provided between the pressure responsive driver and a fixed stop within the apparatus housing to prevent damage to elements of the switching apparatus when the same is subjected to over-pressurization. The apparatus as herein described represents a preferred embodiment and best mode of carrying out the invention, but it is to be understood that it is susceptible of various modifications without departing from the scope of the appended claims.

I claim:

1. A plural set point pressure switch comprising:

a pressure responsive driving element;

an actuator driven by said driving element;

a plurality of electric switches operated by said actuator;

a plurality of force responsive means blocking movement of said actuator and respectively sequentially unblocking said actuator for driven movement at respective predetermined pressure values;

a plurality of stop means respectively associated with said plurality of force responsive means, said stop means respectively sequentially arresting said driven movement of said actuator at respective increments of travel wherein said actuator operates a respective switch in each said increment of travel;

a plurality of separate adjustment means each individually respectively associated with said plurality of force responsive means and said plurality of stop means for adjustibly applying an individual initial force to each respective said force responsive means.

2. A plural set point pressure switch as claimed in claim 1 wherein at least one of said stop means arresting said driven movement of said actuator is subsequently driven by said driving element coincidentally with said actuator.

3. A plural set point pressure switch as claimed in claim 2 wherein said force responsive means comprise breakover devices instantaneously changing from blocking to unblocking states.

4. A plural set point pressure switch as claimed in claim 3 wherein said force responsive breakover devices comprise snap spring discs.

5. A plural set point pressure switch as claimed in claim 4 wherein said actuator comprises resilient means operating said switches, said resilient means being deflected during subsequent increments of travel of said actuator.

6. A dual set point pressure switch comprising:

a pressure responsive driving element;

an actuator driven by said driving element;

first an second electric switches operated by said actuator;

first force responsive means blocking movement of said actuator and unblocking said actuator for driven movement at a first predetermined pressure value;

first stop means arresting said driven movement of said actuator at a first increment of travel wherein said actuator operates said first switch, said first stop means thereafter being driven coincidentally with said actuator by said driving element;

said first force responsive means being disposed between said actuator and said first stop means, said first stop means comprising means for adjustibly applying an initial force to said first force responsive means;

second force responsive means blocking movement of said first stop means and said actuator and unblocking said first stop means and said actuator for driven movement at a second predetermined pressure value;

second stop means arresting said driven movement of said first stop means and said actuator at a second increment of travel wherein said actuator operates said second switch;

said second force responsive means being disposed between said first stop means and said second stop means, said second stop means comprising means for adjustibly applying an initial force to said second force responsive means independently of said initial force applied to said first force responsive means.

7. A dual set point pressure switch as claimed in claim 6 wherein said force responsive means comprise breakover devices instantaneously changing from blocking to unblocking states upon force applied thereto by said driving element attaining a respective value corresponding to a respective said predetermined pressure value, said driving element thereby abruptly imparting rapid movement to said actuator.

8. A dual set point pressure switch as claimed in claim 7 wherein said first and second switches comprise contacts operated by depression of respective plunger operators biased to extended positions, said actuator imparting abrupt rapid depression of said plunger operators.

9. A dual set point pressure switch as claimed in claim 8 wherein said first and second switches comprise self-contained snap-action switch modules.

10. A dual set point pressure switch as claimed in claim 9 wherein said breakover devices comprise snap spring discs.

11. A dual set point pressure switch as claimed in claim 7 wherein said breakover devices abruptly return to said blocking state when said force corresponding to said pressure reduces to a value below a respective said predetermined value.

12. A dual set point pressure switch as claimed in claim 11 wherein said breakover devices returning to respective said blocking states impart driving forces on said first stop means and said actuator in a direction opposite to driven movement of said driving element.

13. A dual set point pressure switch as claimed in claim 6 wherein said actuator comprises resilient means operating said first switch during said first increment of travel and being deflected during said second increment of travel of said actuator.

14. A dual set point pressure switches as claimed in claim 8 wherein said actuator comprises a button engagable with a respective plunger operator of said first switch for operating said first switch during said first increment of travel, said button being spring biased to an extended position and depressed by said first switch plunger operator during said second increment of travel.

15. A dual set point pressure switch as claimed in claim 6 wherein driven movement of said actuator by said driving element is absolutely limited to a sum of said first and said second increments of travel by said driving element abutting said first stop means in said first increment of travel and said first stop means subsequently abutting said second stop means in said second increment of travel, thereby forming a solid link between said driving element and said second stop means preventing excessive movement of elements of said pressure switch due to high pressure values.

16. A dual set point pressure switch as claimed in claim 6 wherein said driving element comprises adjustment means for simultaneously adjusting initial force applied to said actuator and to said first top means.

17. Dual set point pressure responsive electric switching apparatus comprising:

first and second electric switches;

a pressure responsive driver;

a two-stage lost motion actuator directly driven by said driver sequentially operating said first and second switches;

a fixed end stop and an intermediate stop movable relative to said end stop; and first and second force breakover devices respectively abruptly changing from an initial condition to a secondary condition when force applied thereto attains a respective predetermined value, said first breakover device being disposed between said intermediate stop and said actuator and said second breakover device being disposed between said intermediate stop and said end stop;

said intermediate stop limiting movement of said actuator and said driver upon condition change of said first breakover device, thereby defining a first increment of travel of said actuator wherein said first switch is operated, said driver thereafter applying force to and moving said intermediate stop and said actuator coincidentally, said end stop limiting movement of said actuator and said intermediate stop over condition change of said second breakover device, thereby defining a second increment of travel of said actuator wherein said second switch is operated;

said intermediate stop comprising an adjustable seat against which said first breakover device bears, adjustment of said second applying initial force on said first breakover device for varying the force value at which said first breakover device changes conditions; and said end stop being adjustible toward and away from said intermediate stop for applying initial force on said second breakover device separately and independently of said initial force on said first breakover device for varying the force value at which said second breakover device changes conditions.

18. Dual set point pressure responsive electric switching apparatus as claimed in claim 17 wherein said force breakover devices abruptly change back from said secondary condition to said initial condition when said force applied thereto recedes below a respective said predetermined value.

19. Dual set point pressure responsive electric switching apparatus as claimed in claim 18 wherein said force breakover devices drive said actuator in a direction reverse that of said pressure responsive driver when said breakover devices change back from said secondary to said initial conditions, thereby sequentially reversely operating said second and said first switches, respectively.

20. Dual set point pressure responsive electric switching apparatus as claimed in claim 19 wherein said second force breakover device abruptly drives said intermediate stop against a fixed stop when changing back to said initial condition, and said first force breakover device abruptly drives said actuator against said intermediate stop when changing back to said initial condition.

21. Dual set point pressure responsive electric switching apparatus as claimed in claim 17 wherein said two-stage lost motion actuator comprises resilient means operating said first switch during said first increment of travel and being deflected by said first switch while maintaining said first switch operated during said second interval of travel.

22. Dual set point pressure responsive electric switching apparatus as claimed in claim 21 wherein said first and second switches comprise self-contained snap action switch modules having depressible operator plungers and said resilient means of said actuator comprises a button biased to an extended position aligned with an operator plunger of said first switch module, said button depressing said plunger operator during said first increment of travel and being depressed by housing structure of said first switch module during said second increment of travel.

23. Dual set point pressure responsive electric switching apparatus as claimed in claim 17 protected against damage by over pressurization of the apparatus wherein driven movement of said actuator by said driver moves said actuator with respect to said intermediate stop until said driver abuts said intermediate stop, said driver subsequently driving said intermediate stop and said actuator simultaneously until said intermediate stop abuts said end stop, thereby forming a solid link between said driver an said end stop which cannot be compressed by additional pressure on said driver.

24. Dual set point pressure responsive electric switching apparatus as claimed in claim 19 wherein said pressure responsive driver is adjustable toward and away from said actuator and said intermediate stop for simultaneously adjusting initial force on said first and second breakover devices.

* * * * *